US006560931B1

(12) United States Patent
Cermola

(10) Patent No.: US 6,560,931 B1
(45) Date of Patent: May 13, 2003

(54) HATCH ASSEMBLY WITH MODULAR INSTALLATION CONSTRUCTION AND HATCH COVER LIFT ASSEMBLY

(76) Inventor: Steven G. Cermola, 253 Peck Hill Rd., Woodbridge, CT (US) 06525

( * ) Notice: Subject to any disclaimer, the term of this patent is extended or adjusted under 35 U.S.C. 154(b) by 0 days.

(21) Appl. No.: 09/824,162

(22) Filed: Apr. 2, 2001

(51) Int. Cl.[7] ..... E05F 1/10
(52) U.S. Cl. ..... 49/386; 16/308
(58) Field of Search ..... 49/386, 387; 16/304, 16/308

(56) References Cited

U.S. PATENT DOCUMENTS

| | | | | | |
|---|---|---|---|---|---|
| 4,951,323 | A | * | 8/1990 | Shalom | 49/386 |
| 5,134,805 | A | * | 8/1992 | Frantzen et al. | 49/386 |
| 5,335,451 | A | * | 8/1994 | Druzynski | 49/386 |
| 6,000,071 | A | * | 12/1999 | Fettes | 49/386 |
| 6,446,307 | B2 | * | 9/2002 | Wilkins | 16/308 |

* cited by examiner

*Primary Examiner*—Jerry Redman
(74) *Attorney, Agent, or Firm*—Alix, Yale & Ristas, LLP

(57) ABSTRACT

A universal hatch assembly for accessing an enclosure includes a door. The frame has an opening defined therein that is dimensioned and configured for mounting the door. A hinge apparatus allows pivotal movement of the door about a first axis between a first position in which the door covers the opening and a second open position. The interior side of the door has an elongated channel extending in substantially perpendicular relationship to the first axis. An operating lever for positioning the door, has first and second axial extremities. A first axial part of the operating lever is spaced apart from the second axial extremity which is pivotally connected to the frame. The second axial extremity is dimensioned and configured for sliding meshing engagement with the elongated channel. The hatch assembly includes a lift assembly to provide a favorable counterbalance for the door. The frame may include a peripheral groove extending around substantially the entire frame. At least one module selected from several different modules according to a given application has a mounting surface dimensioned and configured for engaging the peripheral groove.

18 Claims, 20 Drawing Sheets

HATCH ASSEMBLY WITH MODULAR INSTALLATION CONSTRUCTION AND HATCH COVER LIFT ASSEMBLY

BACKGROUND OF THE INVENTION

This invention relates to building construction and particularly to hatch assemblies. Such hatch assemblies typically include a hatch having a hinged cover. This invention has application to various types of hatches including, but not limited to:

(1) exterior sidewalk hatches also known as vault or pit access hatches or horizontal doors;

(2) interior floor hatches also known as horizontal floor doors;

(3) roof hatches also known as roof scuttles or roof access doors; and (4) automatic fire vents also known as heat and smoke vents.

Historically, the construction industry has utilized hatches designed and constructed for specific installations. For example, a roof hatch conventionally is typically manufactured and constructed in a manner that does not facilitate adaptation of that hatch for use as an exterior sidewalk hatch. Known hatch constructions utilize a variety of means to assist the user in opening the door of the hatch assembly. These means include compression springs having either a vertical or a horizontal axis, torsion bars, torsion coil springs, gas struts, and telescoping compression springs.

SUMMARY OF THE INVENTION

An object of the present invention is to provide a hatch assembly having interchangeable installation modules to facilitate installation of the hatch assembly in a variety of different types of physical locations without the necessity of welding structural elements for a given application.

Thus, an object of the invention is to provide a hatch assembly that includes interchangeable modular elements that may be configured for use as an exterior sidewalk hatch, an interior floor hatch, or a roof hatch.

Another object of the invention is to provide a spring mechanism which imparts favorable counterbalancing characteristics to facilitate opening of the hatch in a reliable consistent manner.

Still another object of the invention is to provide a spring mechanism that is compact and disposed and constructed to minimize interference both with the passageway provided in the hatch assembly and with the hinged cover.

Yet another object of the invention is to provide apparatus having a more standardized and more uniform characteristic which is also adaptable to a wide range of applications and environments to thereby realize production efficiencies and reduce inventory requirements throughout manufacturing and product distribution channels.

A further object of the invention is to provide structure that incorporates a lifting mechanism that is compact and does not extend vertically and which thereby expands possible installation sites by minimizing potential interference between the lifting mechanism and the support structure and the hatch assembly structure.

It now has been found that these and other objects of the invention may be attained in a universal hatch assembly for accessing an enclosure which includes a door having a first side and a second side. The frame has an opening defined therein that is dimensioned and configured for engaging the door and the assembly also includes hinge apparatus mounting the door to the frame. The hinge apparatus allows pivotal movement of the door about a first axis between a first position in which the door covers the opening and a second position in which the door does not cover the opening. The first side of the door is disposed in facing relationship to the enclosed chamber when the door covers the opening. The first side of the door has an elongated channel extending in substantially perpendicular relationship to the first axis. The assembly also includes an operating lever for positioning the door. The operating lever has first and second axial extremities. A first axial part of the operating lever spaced apart from the second axial extremity is pivotally connected to the frame. The second axial extremity is dimensioned and configured for sliding meshing engagement with the elongated channel. The lift assembly also includes structure for biasing the pivotal position of the operating lever with respect to the frame including a coil extension spring. The lift assembly further includes a cable extending from the coil extension spring to a second axial part of the operating lever that is spaced apart from the first axial part of the operating lever.

In some forms of the lift assembly in accordance with the invention, the coil extension spring has a second axis. The second axis may be disposed in generally parallel relationship to the first axis, although in other forms of the invention the second axis may be perpendicular to the first axis or disposed at an oblique angle with respect to the first axis. The opening may have a first side and the first axis and the second axis may be disposed proximate to the first side. In some forms of the invention, the door has a depending flange and an elongated channel is formed in the depending flange.

A generally cylindrical member may be dimensioned and configured for sliding meshing engagement with the elongated channel. The assembly may further include a sheave cooperating with the cable.

Some forms of the hatch assembly in accordance with the invention may include the features described above in addition to the structural features described below. Other forms of the invention may include only the structural features described below.

The structure of the frame may include a first peripheral groove extending around substantially the entire frame. At least one module has a mounting surface dimensioned and configured for engaging the first peripheral groove. Several types of modules each specifically adapted for a given application are provided.

The hinge apparatus may include first and second plates, coupled by a hinge pin. The frame is dimensioned and configured for receiving the first plate. The second plate engages the door. The first plate has a second groove. The second groove is disposed in registered aligned relationship with the first peripheral groove to define a continuous uniform groove about the entire periphery of the frame. The frame includes a second peripheral groove extending around substantially the entire frame in some forms of the invention. The second peripheral groove may include a plurality of longitudinally extending ridges, dimensioned and configured for engaging a threaded fastener for securing modules to the frame. The first peripheral groove and the second peripheral groove may be parallel and proximate to each other. The module may take the form of a skirt, a clamp, an integral carpet/tile stop, or a flange for supporting and/or positioning the hatch assembly with respect to an opening.

BRIEF DESCRIPTION OF THE DRAWING

The invention will be better understood by reference to the accompanying drawing in which.

DESCRIPTION OF THE PREFERRED EMBODIMENTS

A universal hatch assembly in accordance with present invention may assume a wide number of configurations. Each hatch assembly has a frame that includes mounting surfaces to enable easy attachment of various load-bearing flanges, weather-sealing gaskets and cap-flashing modules without the need for welding or other specialized manufacturing steps. In a preferred embodiment, the hatch assembly includes a compact, horizontally mounted, extension coil spring, lifting mechanism suitable for retrofits and replacement applications as well as original installations. Advantageously, the appropriate modules may be assembled at the job site without the cost and long fabrication times associated with factory custom-made constructions.

Figure 25:
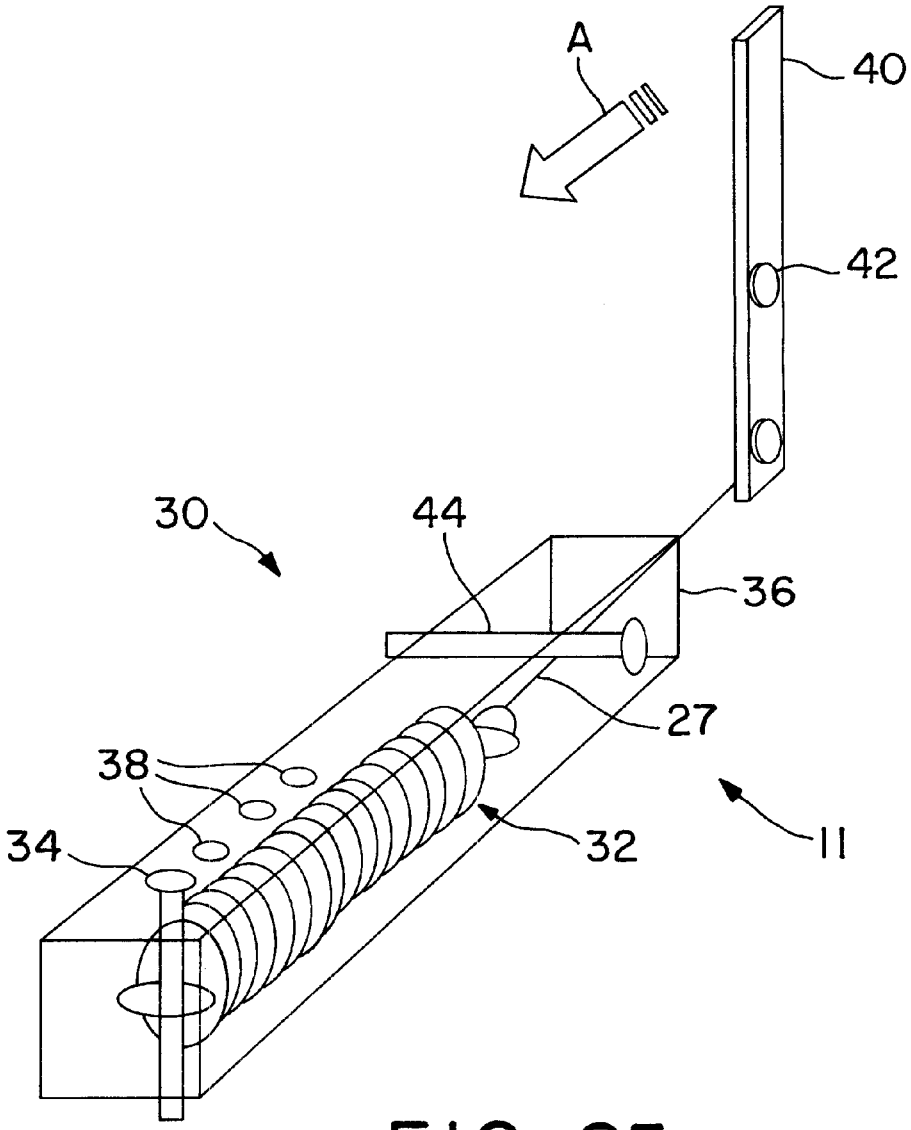
FIG. 25 is a diagrammatic view of an extension spring actuating mechanism.

Referring now to FIGS. 1–8, there is shown a hatch assembly 10 in accordance with one form of the present invention that employs the same lift assembly 11 as that shown diagrammatically in FIG. 25. This hatch assembly 10 includes a cover or door 12 having a stiffener 14 fixed to the interior face thereof. The stiffener is provided with an elongated slot 16 that is rectilinear except for an L-shaped axial extremity 17 (shown in FIG. 3) for locking the door 12 in the open position. Hinges 18 mount the door 12 to the frame 20. An operating lever or hold open arm 22 is pivotally connected by a bolt 29 at a first axial extremity to the frame 20. A second axial extremity of the lever 22 is provided with a cylindrical follower 26 dimensioned and configured for meshing sliding engagement with the slot 16. A coil extension spring assembly 24 is connected by a cable 27 to an axial point 28 on the operating lever 22 intermediate the first and second axial extremities. A sheave 25 guides the cable 27 around the right angle intersection of the sides of the frame 20.

Figure 9:
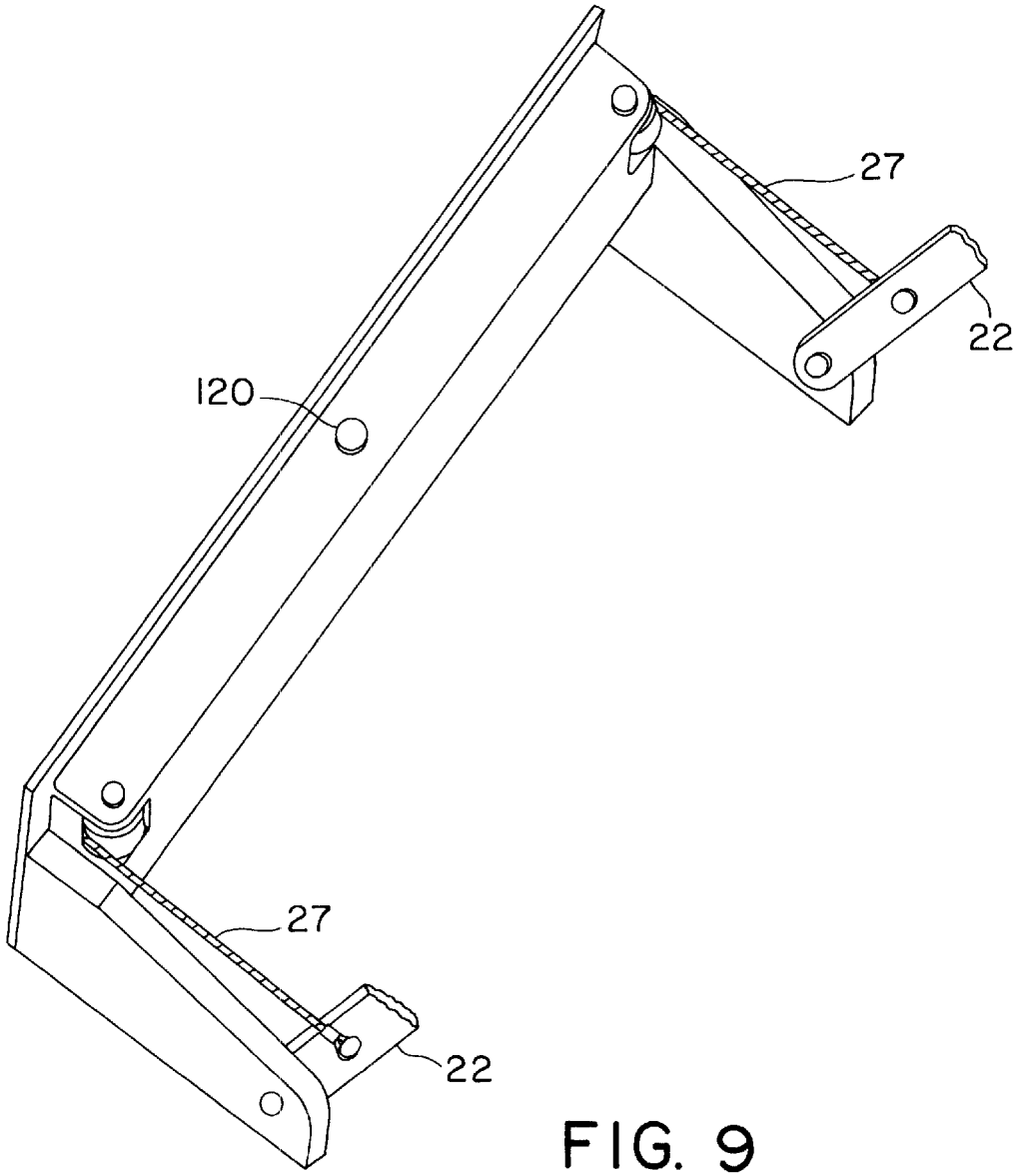
FIG. 9 is a perspective view of an alternate embodiment having a separate cable connecting to each of two-door control levers.
Figure 10:
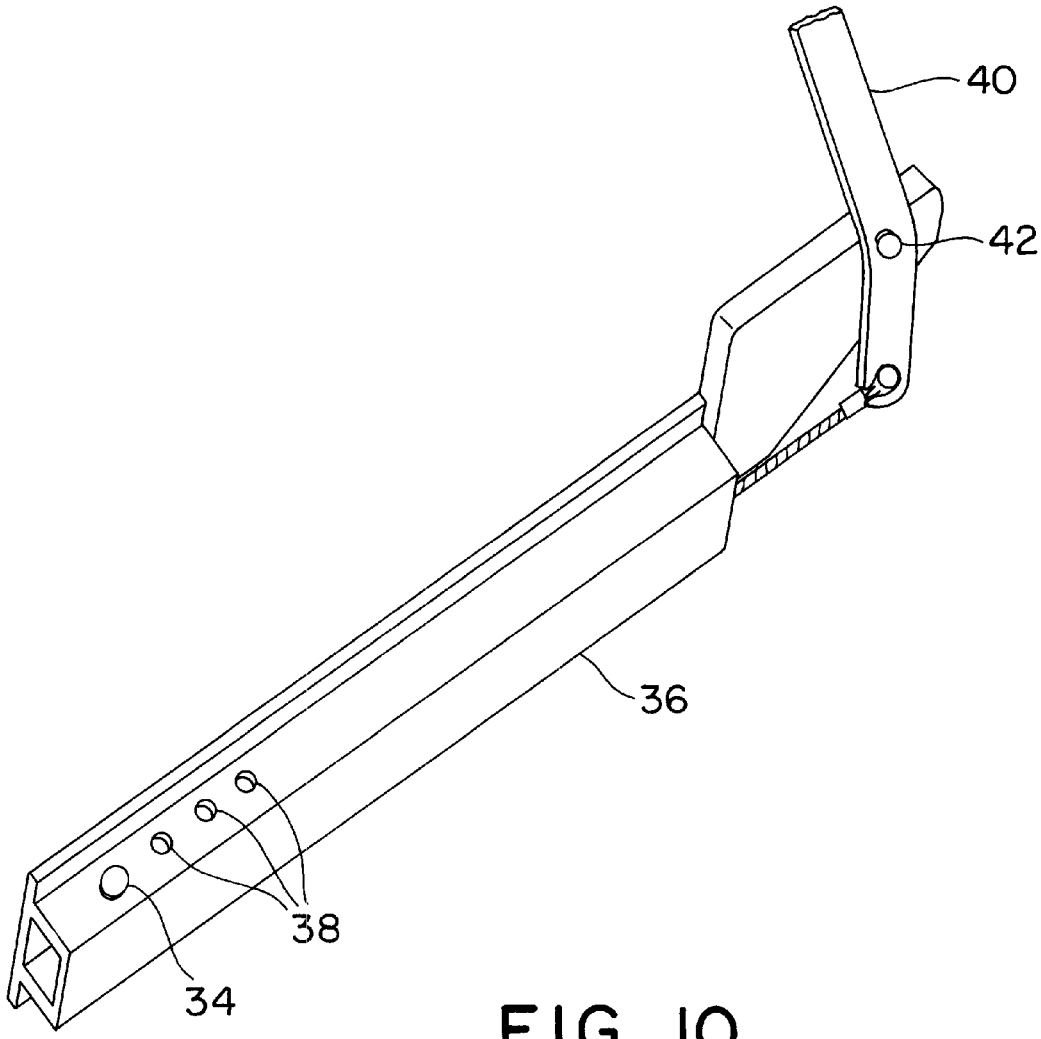
FIG. 10 is a perspective view of another alternate embodiment, having a cable connecting to a door control lever that has a pivot point intermediate to the lever connection to the door, and the lever connection to the cable.
Figure 11:
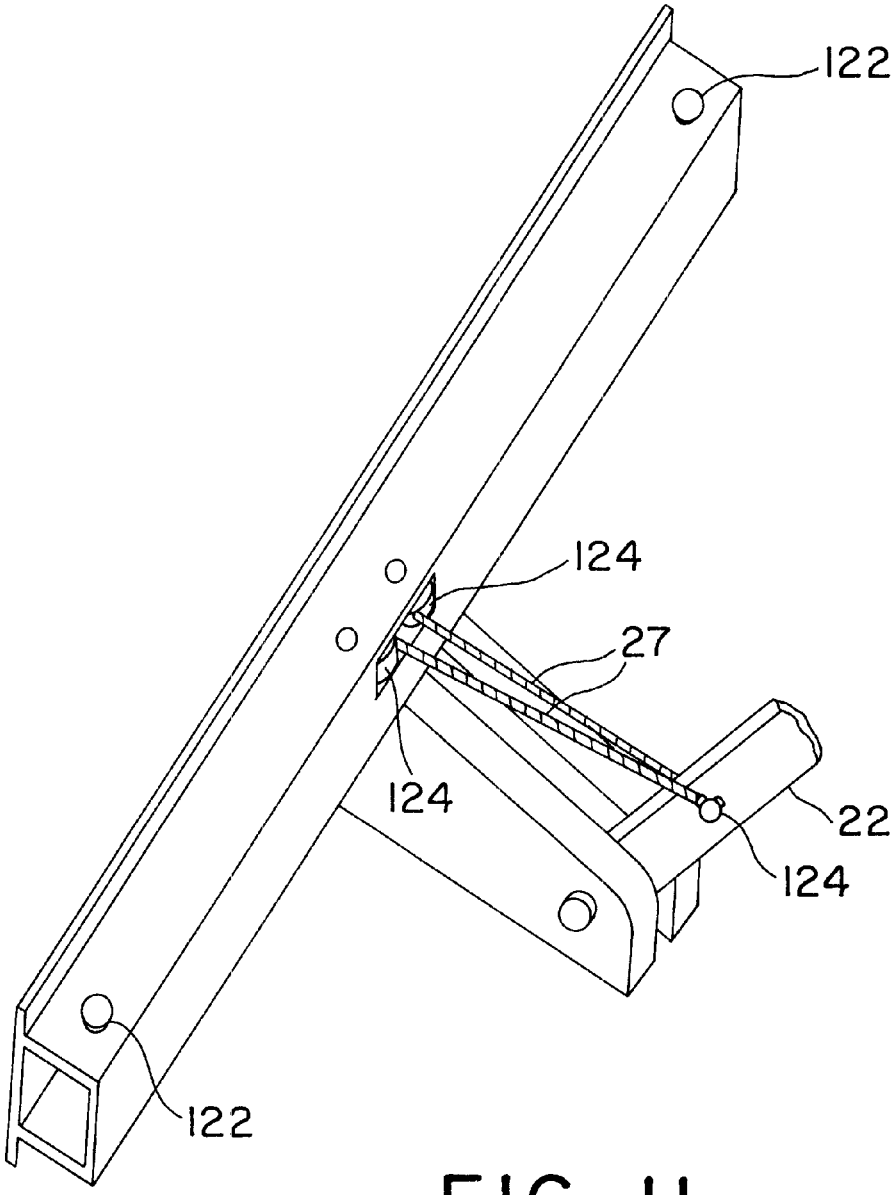
FIG. 11 is a perspective view of still another embodiment in which spring bias cables connect to opposing sides of a door control lever.

The embodiments illustrated in FIGS. 1–8, 10, 25 and 26 each utilizes a single cable 27 connected to a single lever 22 or 40. FIGS. 9 and 11 illustrate alternative embodiments that each incorporates two discrete coaxial coil springs. In the embodiment of FIG. 9, each of two coil springs (not shown) is anchored at a bolt 120 disposed in between two operating levers 22. The operating levers 22 are disposed on opposed sides of the hatch assembly. Ordinarily, the use of two operating levers 22, instead of one operating lever, is reserved for particularly heavy doors 12. FIG. 11 illustrates another embodiment where two coaxial springs (not shown) are respectively fixed to two discrete cables 22. The three ends of the cables 22 are fixed to a common bolt 124 that extends through a single lever 22. This physical arrangement is also most useful when the weight of the door 12 is particularly heavy.

Referring now to FIG. 25, there is shown diagrammatically a coil extension spring actuating mechanism lift assembly 11 in which the axis of the coil spring 32 is aligned with the lever 40. This structure more fully illustrated in FIG. 10 is functionally equivalent to the structure diagrammed in FIG. 25. This coil extension spring actuating mechanism 30 includes a coil extension spring 32. In the embodiment of FIG. 25 the geometric axis of the spring 32 is parallel to the direction of elongation of the lever 40. The left (as viewed) axial extremity of the coil extension spring 32 engages a pin 34. A housing 36, having a generally square cross-section, encloses the spring 32. A plurality of vertically extending holes 38 in the upper and lower surfaces of the housing 36 are dimensioned and configured for retaining the pin 34, at any of a plurality of axial positions. Since the force produced by the spring 32 is proportional to the linear extension of the spring 32, it is possible to adjust the operating characteristics of the coil extension spring actuating mechanism 30 by movement of the pin 34 to a different pair of holes 38.

An operating lever 40 is provided with a pivot 42 that is intermediate the axial extremities of the operating lever 40 (unlike the operating lever 22 that is pivotally connected to the frame 20 at an axial extremity thereof). A cable 26 (preferably a multi strand steel cable, although some embodiments may use nylon or other materials) is attached to the second axial extremity of the spring 32. The cable 26 passes over a guide member 44 and is fixed to the lower (as viewed) axial extremity of the lever 40. The upper axial extremity (not shown) of the lever 40 is provided with a cylindrical follower 26, that engages a slot as in the embodiment illustrated in FIGS. 1, 2 and 3.

Accordingly, if the cover or door 12 is heavy and is otherwise restrained in the closed or horizontal position, the lever 40 is rotated fully around the pivot point 42, in the maximum counterclockwise direction (the direction indicated by the arrow A). The spring 32 is extended to a length corresponding to a spring force necessary to counteract the weight of the cover 12 to provide an efficient and effective counterbalance for the cover 12. Thus, when the cover 12 is opened, the spring 32, exerts a force on the cable 27 that exerts a force on the lever 40, thereby exerting a force on the underside of the cover 12 to lift the cover to the full opening or vertical position. Thus, the mechanism converts a horizontal motion of the extension spring 32 to an upward force.

Figure 26:
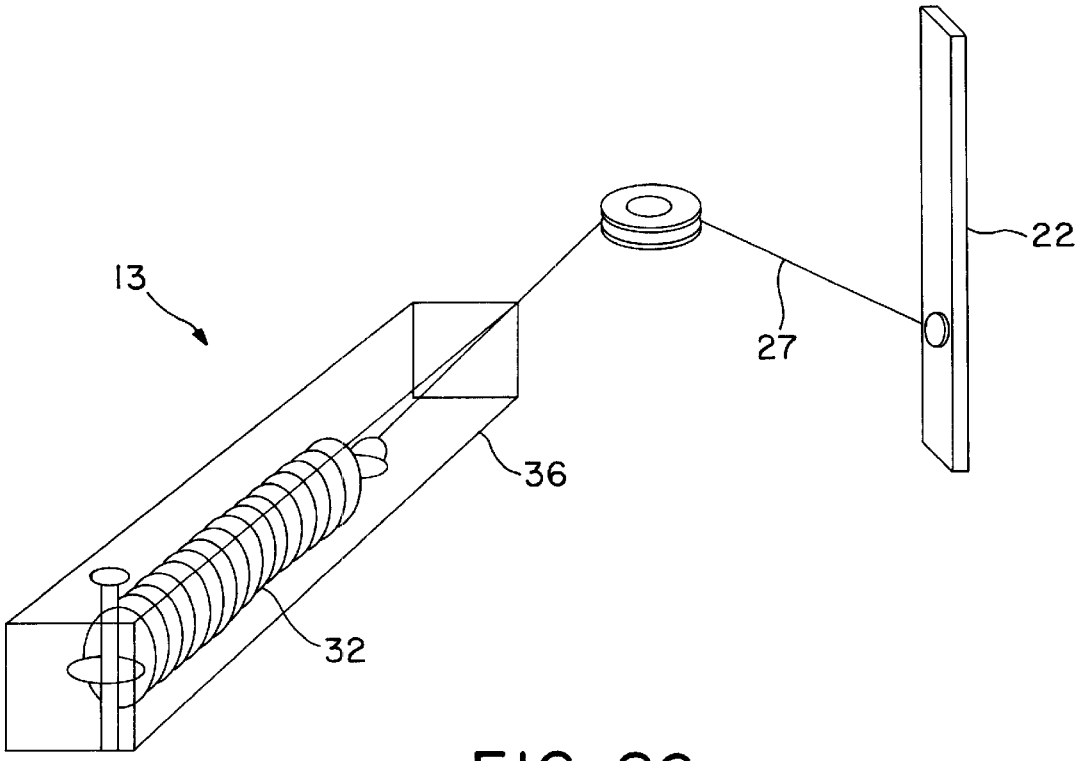
FIG. 26 is a diagrammatic view of an alternate extension spring actuating mechanism.

Referring now to FIG. 26, there is shown a lift assembly 13 in which the geometric axis of the spring 32 is perpendicular to the direction of elongation of the lever 22. (Reference numeral 22 is used herein to identify a lever that is pivotally mounted at an axial extremity of the lever as in the embodiment illustrated FIGS. 1, 2, 3, 4 and 26. Reference numeral 40 is used herein to identify a similar lever that is pivotally mounted at a point intermediate the axial extremities of the lever.) The embodiment shown in FIG. 26 enables the spring housing 36 to be disposed in a position that is not in line with the lever 22. Those skilled in the art will recognize that although the geometric relationship in FIG. 26 is a perpendicular relationship other included angles such as 30, 60, or 120 degrees could be constructed with substantially the same physical structure.

The hatch assemblies employ cover lift assemblies 11 or 13 which efficiently redirect the force of a horizontally mounted coil extension spring into a reliable, predictable, upward-lifting force, without imposing unnecessary torque or other stress on the frame, hinges or the cover. Thus, the lift assemblies 11 and 13 offer significant advantages over existing lifting mechanisms in terms of safety, durability, adjustability, and ease of installation. The use of a coil springs is desirable because of the greater precision associated with such coil extension springs as compared to alternative biasing.

Figure 1:
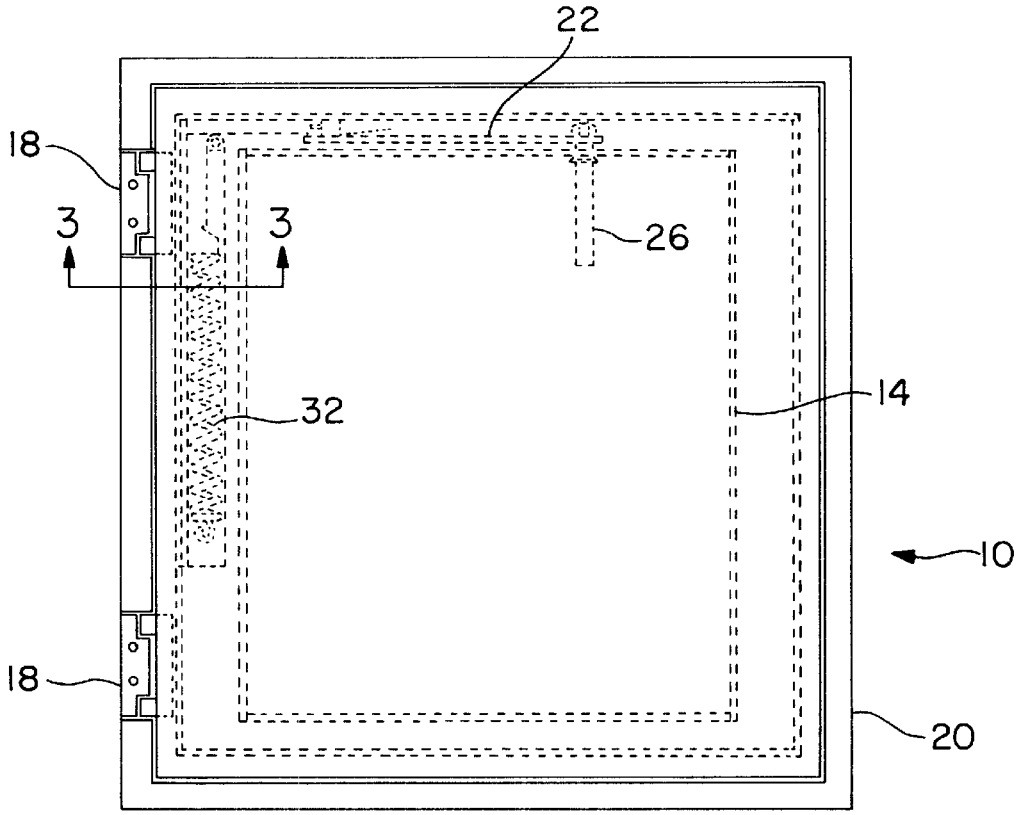
FIG. 1 is a plan view, partly in phantom, of a hatch assembly in accordance with one form of the present invention.
Figure 2:
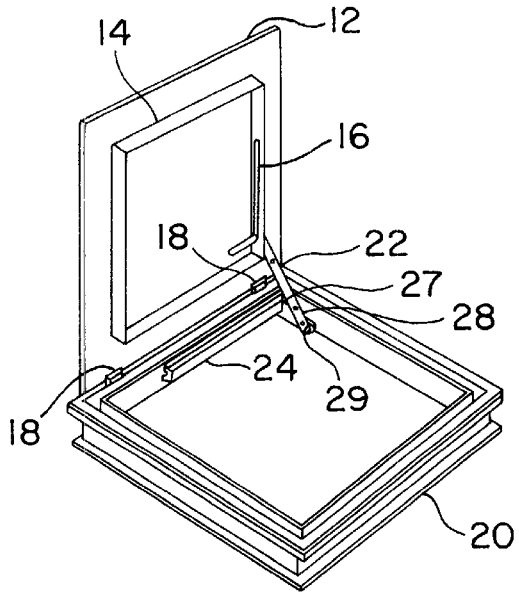
FIG. 2 is a perspective view of the hatch assembly of FIG. 1, with the door disposed in the open position.
Figure 3:
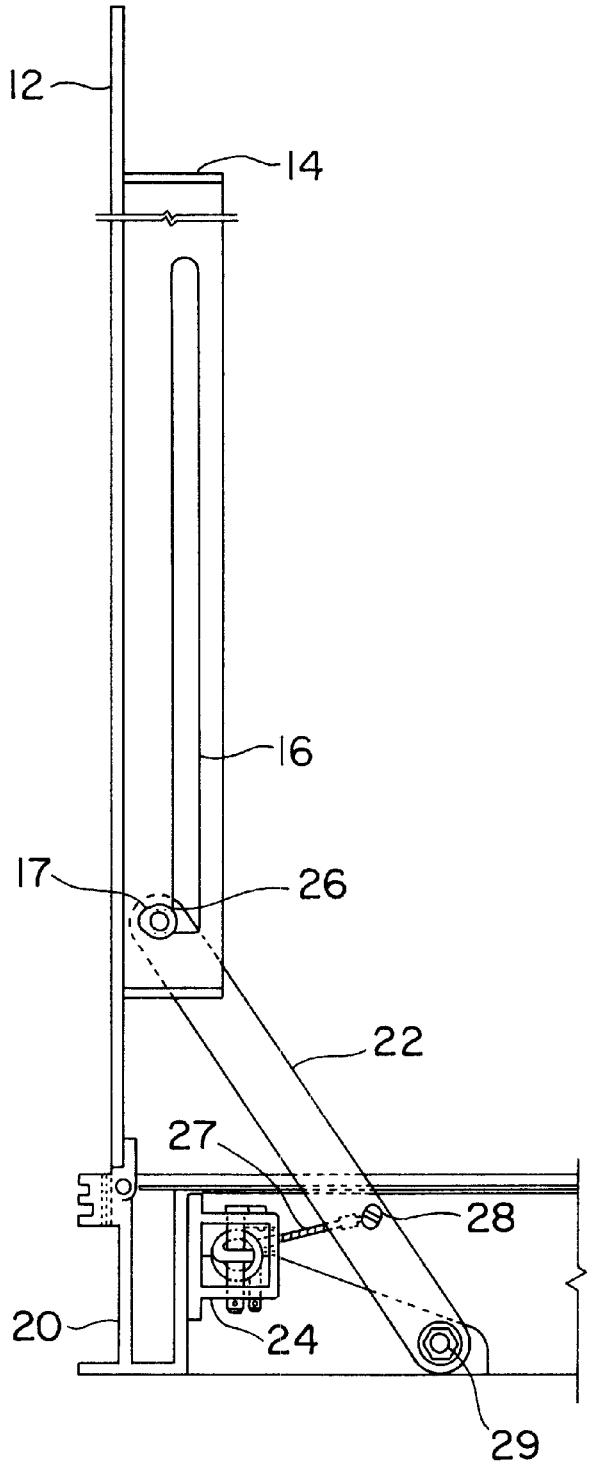
FIG. 3 is a partially sectional view taken along the line 3—3 of FIG. 1, illustrating the position of some of the components when the door is in the open position.
Figure 4:
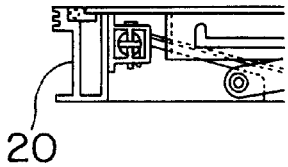
FIG. 4 is a fragmentary elevational view, illustrating some of the elements when the door is in the closed position.
Figure 6:
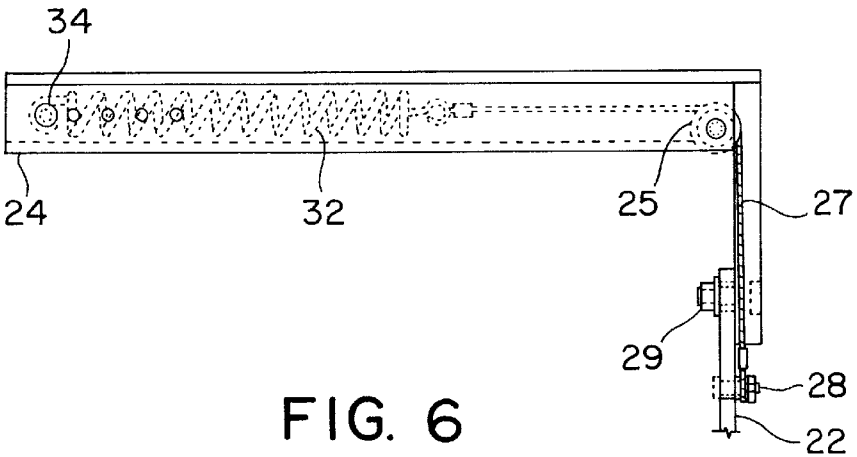
FIG. 6 is a plan view, partially in phantom, of the door control lever and the cable that connects to a coil extension spring to provide counterbalancing forces when the door is opened.
Figure 8:
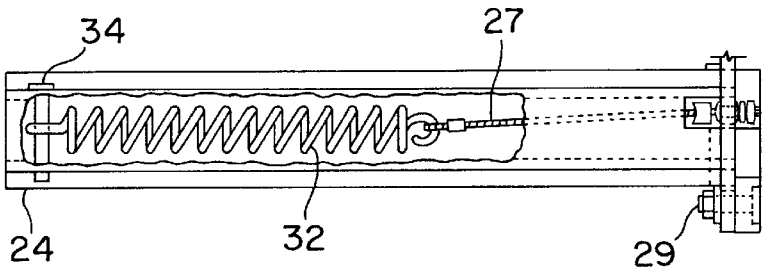
FIG. 8 is a side elevational view, partially in phantom and partially broken away, similar to FIGS. 5, 6 and 7.
Figure 5:
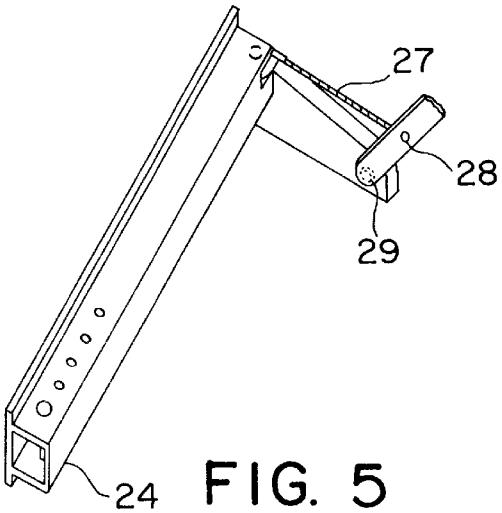
FIG. 5 is a perspective view of the door control lever and the cable that connects to a coil extension spring to provide counterbalancing forces when the door is opened.
Figure 7:
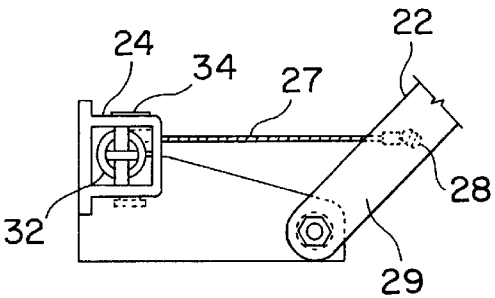
FIG. 7 is an end elevational view similar to FIGS. 5 and 6.
Figure 17:
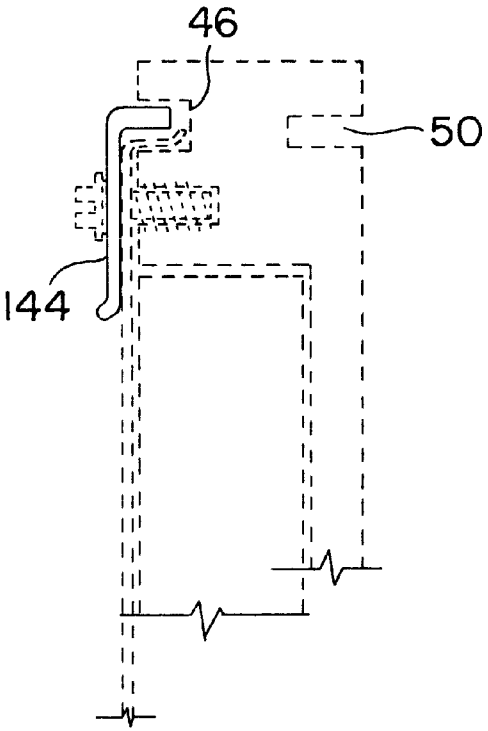
FIGS. 15, 16 and 17 are sectional views of respective skirt modules and installed in various environments as further illustrated by broken lines.
Figure 16:
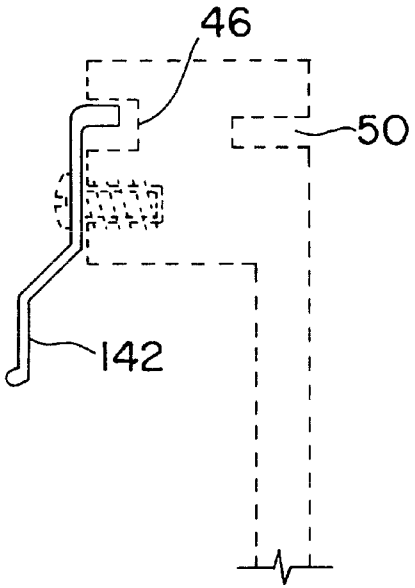
Figure 15:
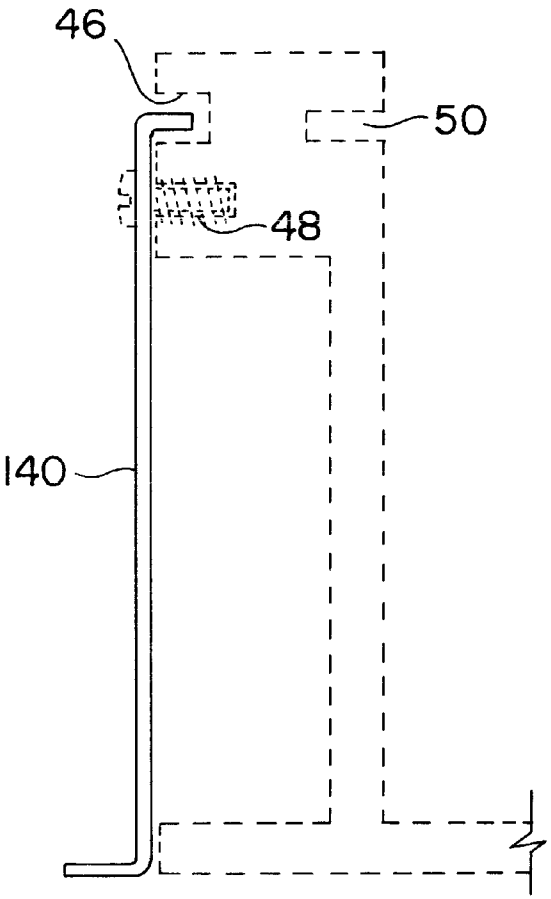
Figure 18:
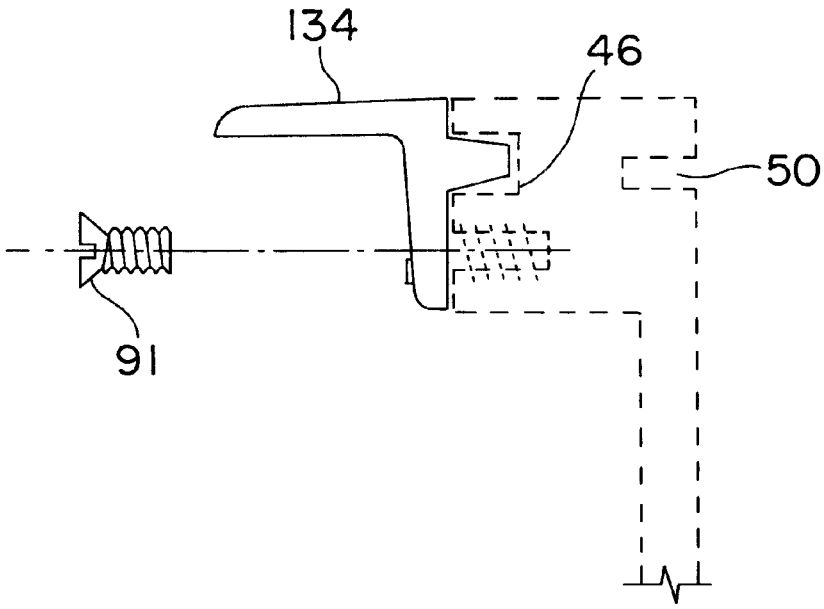
FIGS. 18 and 19 are sectional views of respective flange modules installed in various environments as further illustrated by broken lines.
Figure 19:
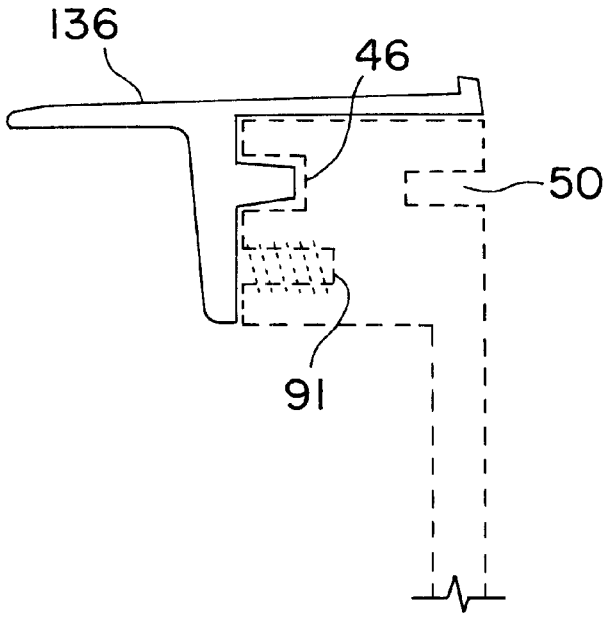
Figure 22:
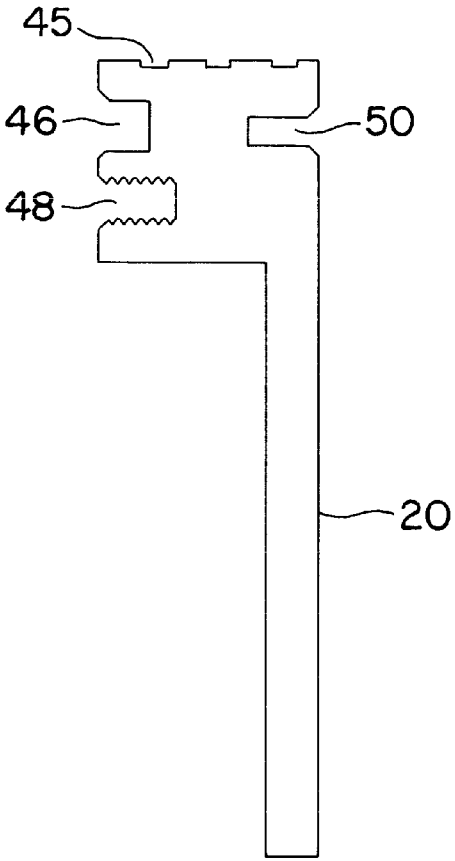
FIGS. 20, 21 and 22 are respective end views of alternate extruded mounting surfaces that cooperate with flange and skirt modules.
Figure 21:
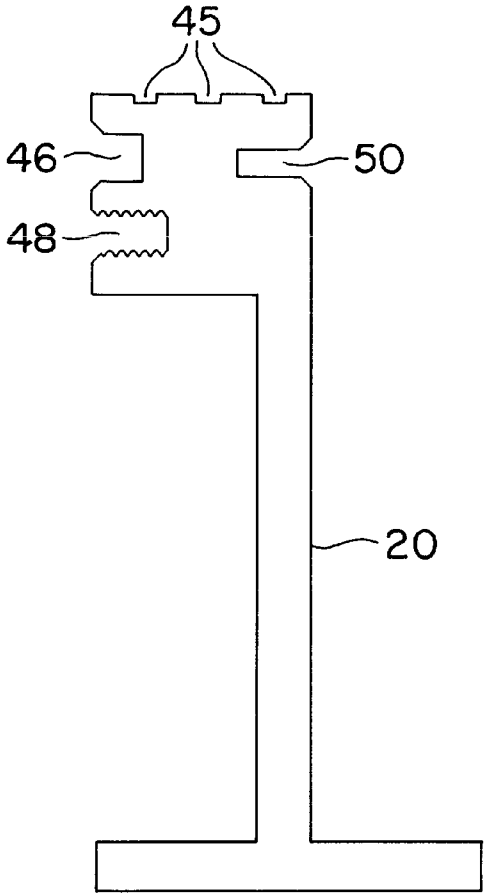
Figure 20:
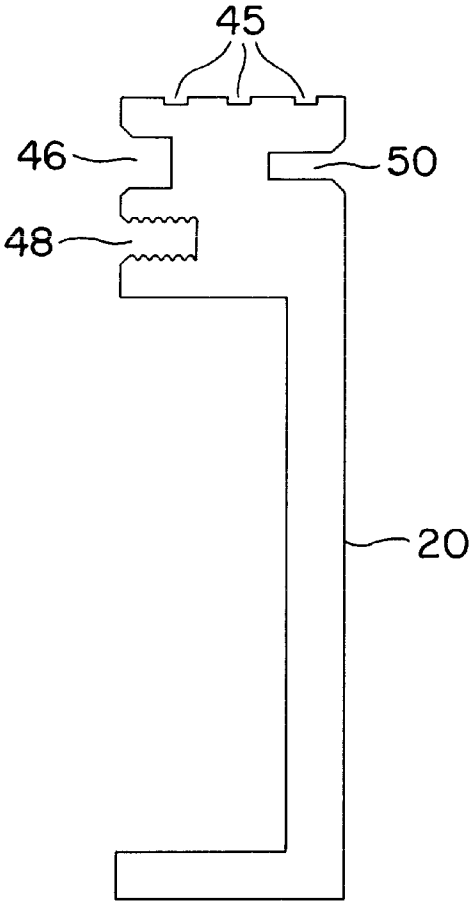
Figure 23:
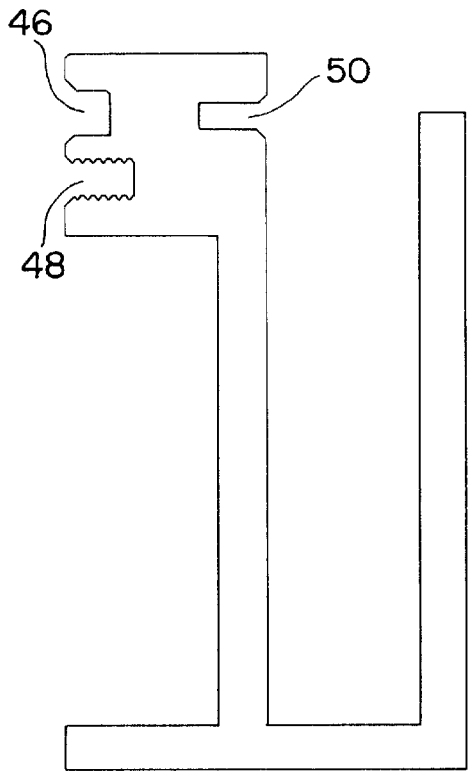
FIGS. 23 and 24 are respectively to side elevation and perspective views of another member configured for cooperation with respective flange and skirt modules.
Figure 24:
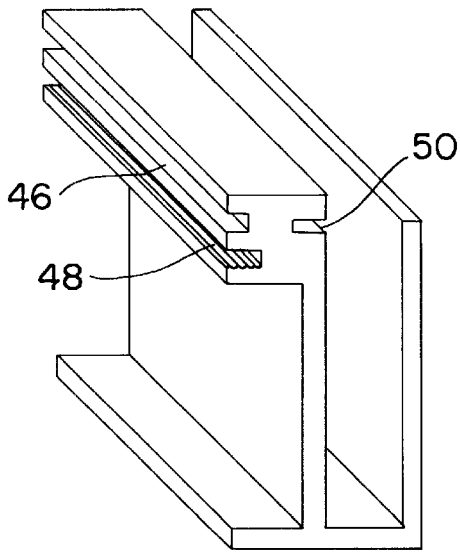
Figure 27:
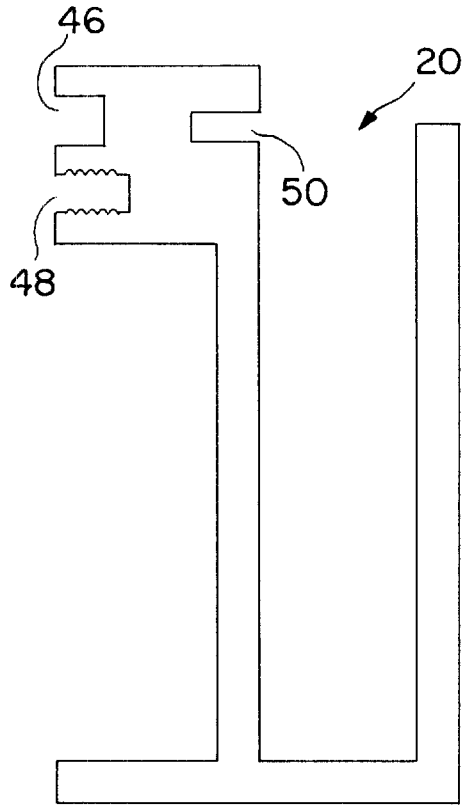
FIG. 27 is a diagrammatic view of a frame section in accordance with a preferred form of the invention.

Referring now to FIG. 27, there is shown a cross-section of the frame 20 that is also shown in FIGS. 1, 2 and 3. The cross-section illustrated in FIG. 27 is identical throughout the circumferential extent of the frame 20 (except as the parts thereof where the hinges 18 are disposed). Alternative frame cross-sections are shown in FIGS. 20–22. The upper face of the members that form the frame 20 is provided with a plurality of parallel grooves 45. The grooves 45 will function to prevent slipping if the hatch assembly is installed where people walk. Alternatively, the grooves are decorative. Alternative flange constructions are shown in FIGS. 18 and 19. FIG. 18 illustrates a standard flange 134 for "drop in" installation of interior or exterior floor hatches. FIG. 19 illustrates a flange 136 with an integral carpet/tile stop that is primarily for interior floor hatches. FIGS. 15, 16 and 17, respectively, illustrate a full exterior skirt 140, a fixed cap flashing 142, and a roof material clamp 144.

The four extrusions which constitute the principal support structure of the generally rectangular frame 20 are provided with first and second peripheral grooves 46, 48 intended to receive and mount various auxiliary structures. More particularly, the groove 46 has a generally square cross-section in the preferred embodiment. The groove 48 has a generally rectangular cross-section wherein the upper and lower surfaces thereof are provided with longitudinally extending ridges or serrations, as best seen in FIGS. 20–23 and 24, that are dimensioned and configured for receiving threaded fasteners as best seen in FIGS. 15–19.

Figure 29:
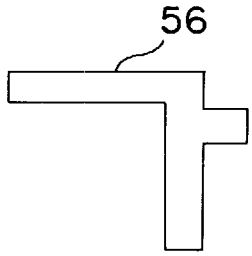

The various auxiliary structures or modules are intended to convert the basic frame 20 from a standard "pour in place" or "surface mount" floor/sidewalk hatch configuration to a "drop in place" floor/sidewalk hatch configuration, a roof hatch configuration or other possible configurations. The frame components and the modules may be extruded structures. For example, the adapter 56 illustrated in FIG. 29 is intended to convert a standard frame from a standard "pour in place" or "surface mount" floor/sidewalk hatch configuration to a "drop in place" floor/sidewalk hatch configuration.

Figure 28:
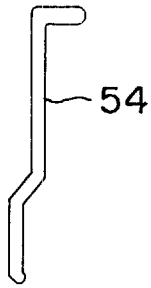
FIGS. 28, 29, 30, and 31 are diagrammatic views of elements that may engage the frame section illustrated in FIG. 27.
Figure 31:
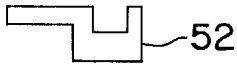

The adapter 54 illustrated in FIG. 28 is intended to convert a standard frame from a standard "pour in place" or "surface mount" floor/sidewalk hatch configuration to a roof hatch configuration. Similarly, the inner face of the frame 20 includes a groove 50 that is also intended to receive and mount various additional structures intended to convert the basic frame 20 for various applications. For example, a weather seal gasket 52 illustrated in FIG. 31 is dimensioned and configured for engagement with the groove 50. The ease with which alternate configurations are achieved with minimal effort and without special tools, glue or welding either at the factory or in the field is a significant advantage of the apparatus of the present invention.

Figure 12:
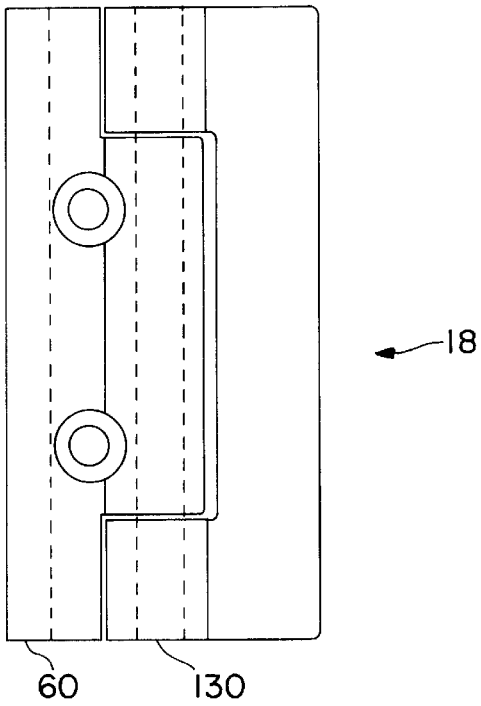
FIGS. 12, 13 and 14 are respectively plan, end elevational and perspective views of the hinge that supports the door, and which also provides part of a continuous circumferential groove about the housing for engagement with a mounting skirt module, FIGS. 12 and 13 being partially in phantom.
Figure 14:
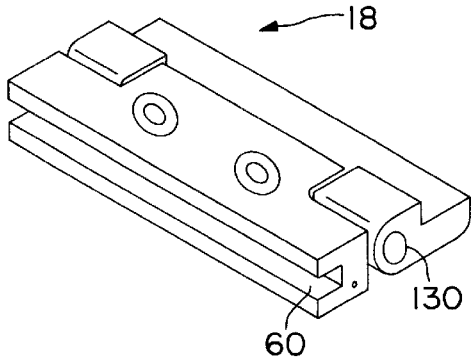
Figure 13:
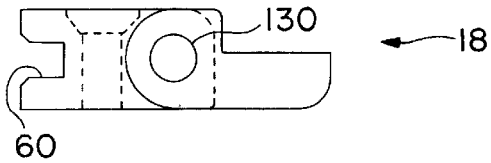
Figure 30:
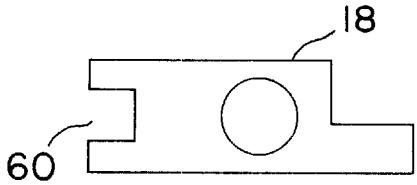

FIG. 30 illustrates a cross-section of the hinge 18 that is also shown in FIGS. 1, 2 and 3. The left (as viewed in FIG. 30) portion of the hinge 18 is provided with a peripheral groove 60 that is dimensioned and configured for alignment and registration with the groove 46 so that one continuous groove extends completely around the circumferential extent of the frame 20. FIGS. 12–14 illustrated the hinge 18 in still greater detail.

Figure 32:
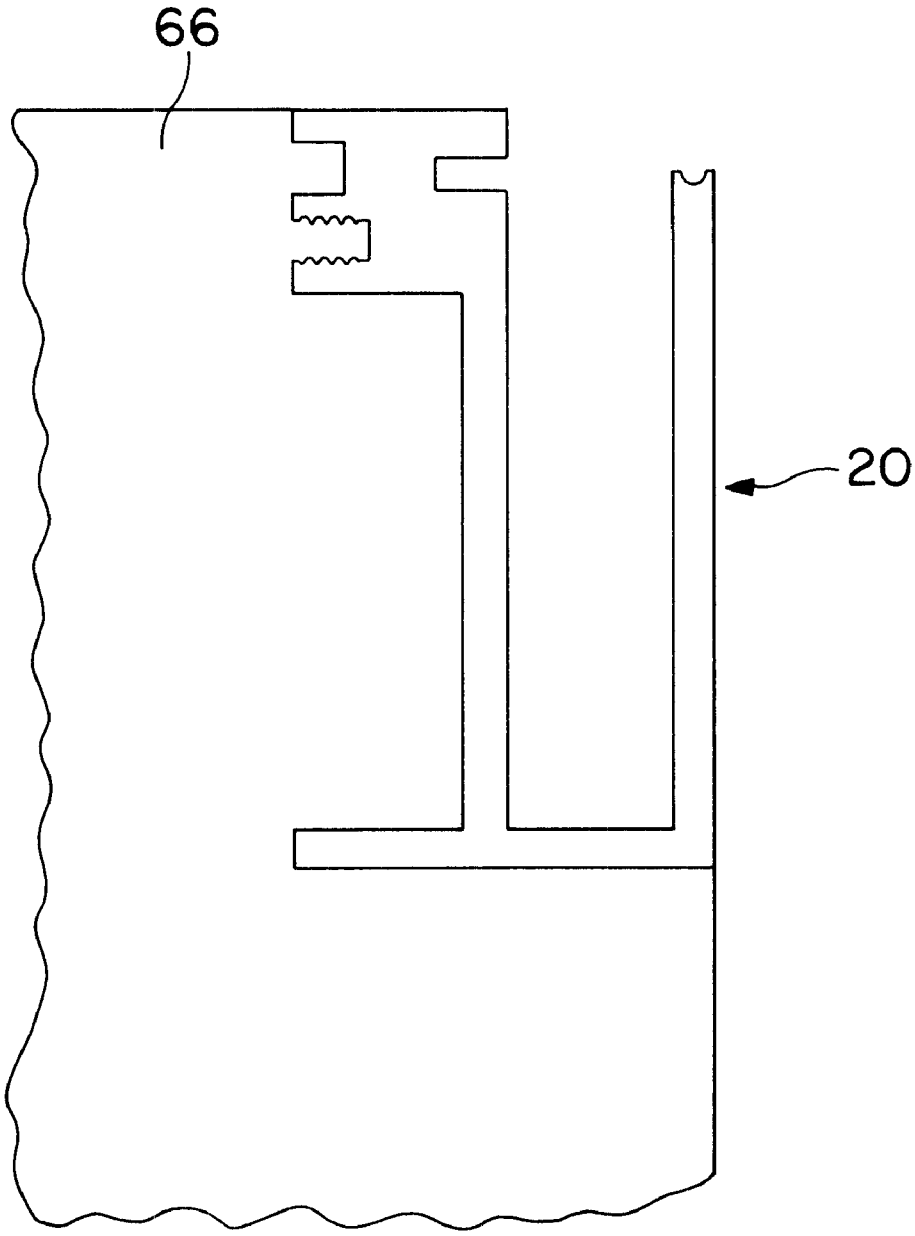
FIG. 32 is a diagrammatic view of the frame section illustrated in FIG. 27 showing a forward in place installation, the most common installation method, for exterior sidewalk hatches in new construction.
Figure 33:
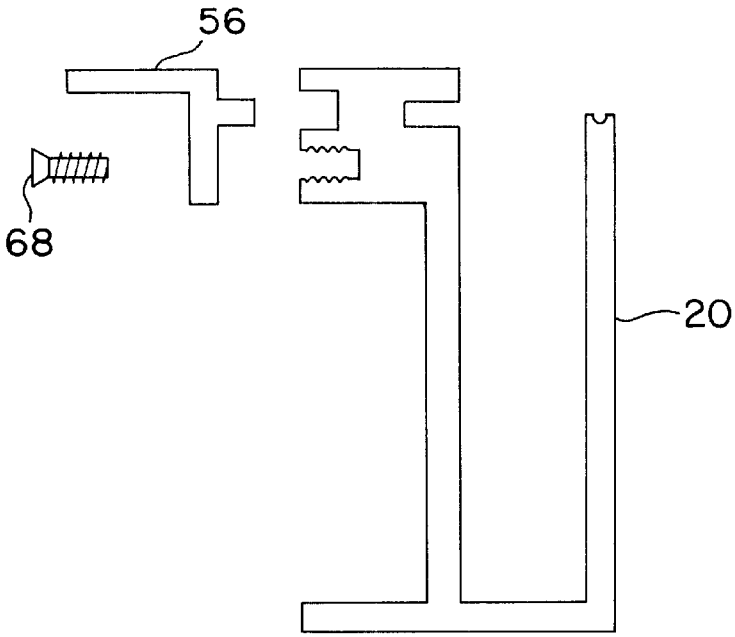
FIG. 33 is a diagrammatic exploded view of the frame section illustrated in FIG. 27, together with a mating element and screw fastener for a drop in installation, the most common installation method, for interior floor hatches or exterior sidewalk hatches where an opening already exists prior to installation.
Figure 34:
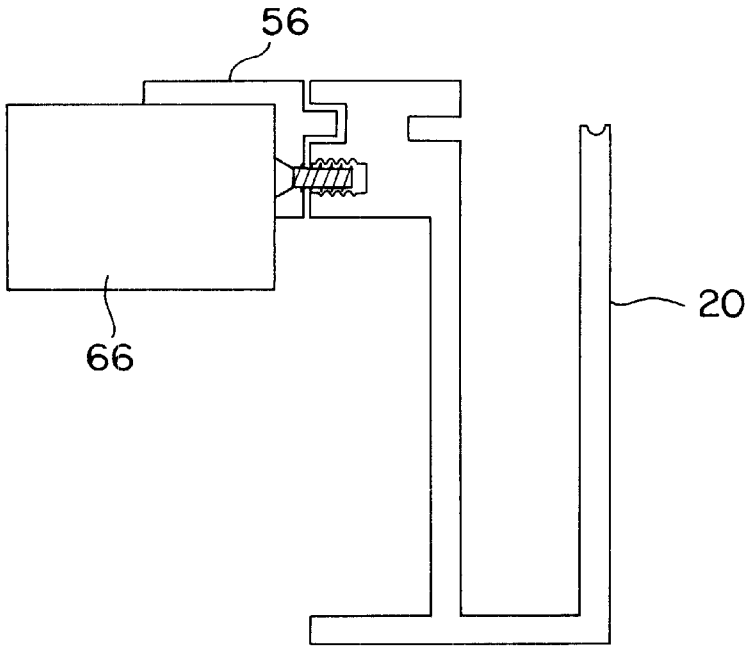
FIG. 34 is a diagrammatic view of the apparatus illustrated in FIG. 33 fully assembled and dropped into an existing opening.

Referring now to FIG. 32, there is shown the cross-section of the frame 20 with poured concrete 66 disposed around the outer and bottom portions of the frame 20. This is a "poured in place" installation. FIGS. 33 and 34 show respectively the adapter 56, illustrated in FIG. 29, together with a fastener 68 in exploded relationship with a frame 20, as well as assembled to the frame 20 in a "drop in" installation. In other words, in a concrete surface 66 defines an opening, such as a sidewalk opening, and the hatch assembly is dropped into the opening.

Figure 35:
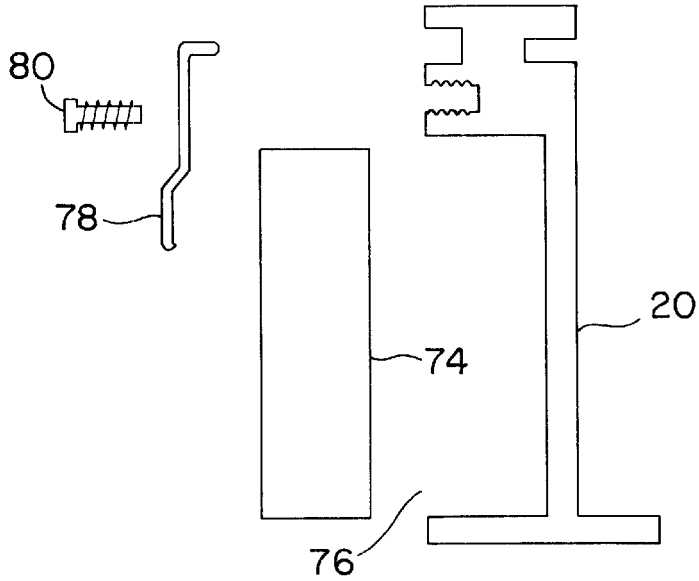
FIG. 35 is a diagrammatic exploded view of the frame section of FIG. 27 in combination with associated elements for a common roof installation.
Figure 36:
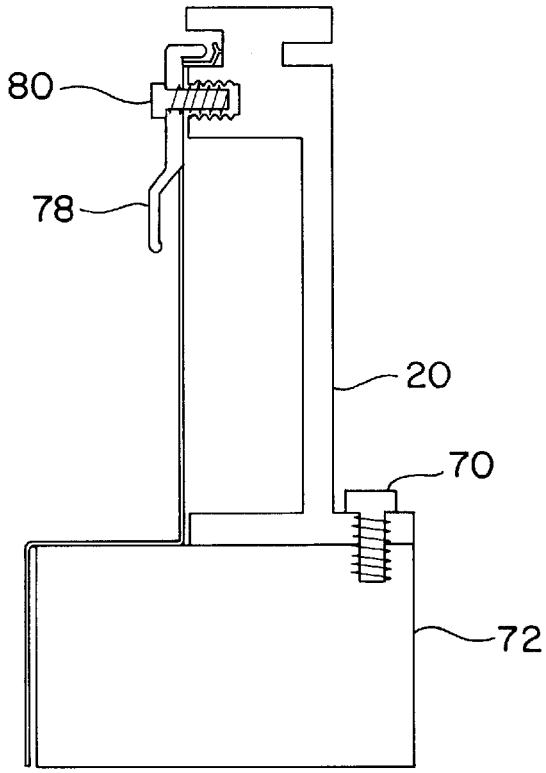
FIG. 36 is a diagrammatic view of the elements shown in FIG. 35, fully assembled and installed on an associated roof.
Figure 37:
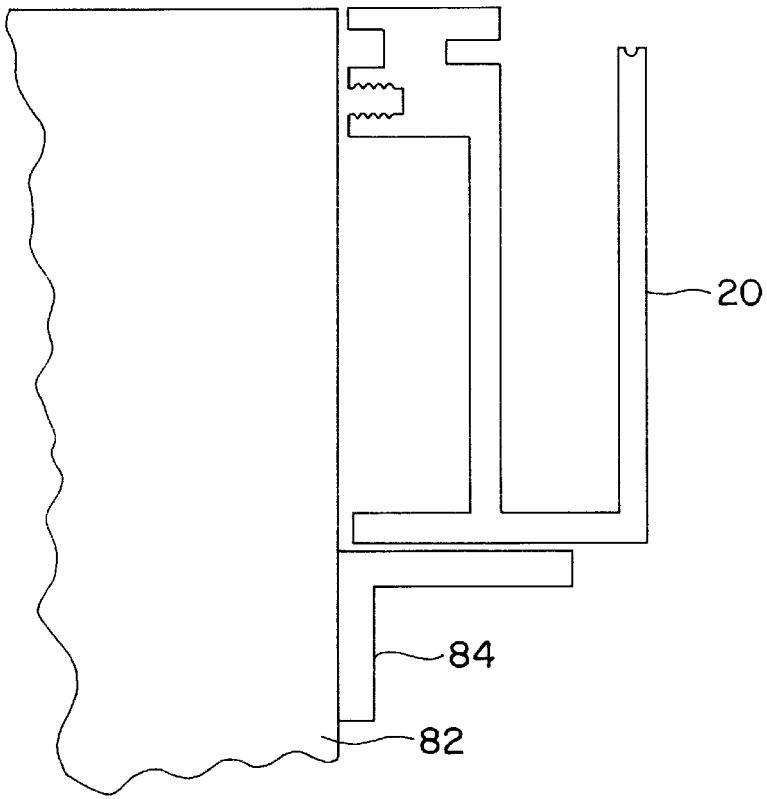
FIG. 37 is a diagrammatic view of the frame section shown in FIG. 27, supported by a support angle fixed to a concrete slab.

As shown in FIGS. 35 and 36, the frame 20 is bolted with bolts 70 to a roof 72. Optional insulation 74 may be installed in the recess 76 and a skirt 78 may be secured with a bolt 80. The system preferably includes various other caps flashing, flashing clamps and full skirts for various types of waterproof roof constructions. FIG. 37 illustrates still another "drop in" construction, utilizing a support angle 84 that is secured to the side of a concrete wall 82. The frame 20 is dropped in and rests on the support angle 84 with the top of the frame 20 disposed in substantially flush relationship to the top surface of concrete 82. The side of the frame 20 is disposed in side abutting relationship to the concrete 82.

Figure 38:
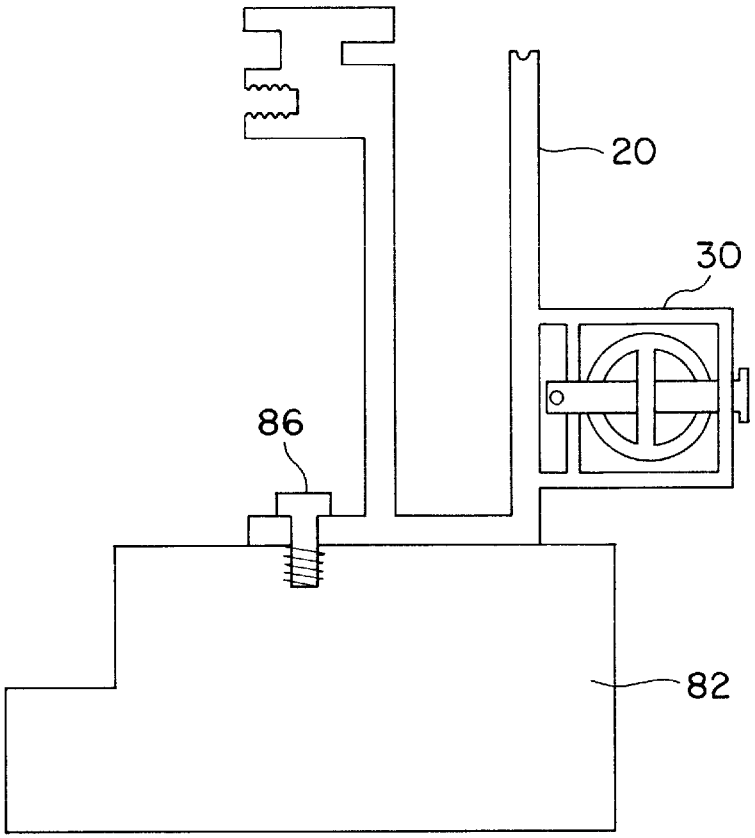
FIG. 38 is a diagrammatic view of a surface mount installation of the frame section illustrated in FIG. 27 in combination with a generally planar associated structure and which illustrates the clearance between the lifting mechanism and the support structure.

FIG. 38 illustrates still another surface mount installation in which the frame 20 is secured by a bolt 86 to a concrete support 82. A coil extension spring actuating assembly 30 is disposed on the side of the frame. Advantageously, the horizontal mounting of the coil extension spring actuating assembly 30 provides ample clearance for the surrounding structure without compromising access through the hatch assembly. This is notably superior to other mechanisms that assist the user to lift the door 12. More particularly, such conventional structures often have portions that extend downward and thus, in the case of the specific environment shown, interfere with the concrete 82, as illustrated in FIG. 38.

Figure 39:
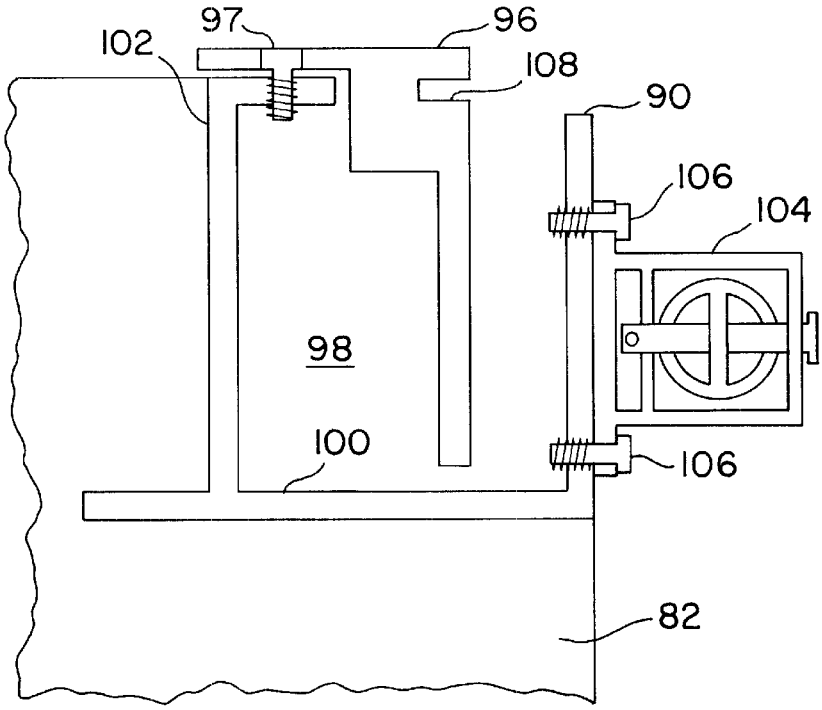
FIG. 39 is a diagrammatic view, illustrating a retrofit installation of an existing industry standard hatch assembly with a frame section, and a lifting mechanism in accordance with the present invention.

Referring now to FIG. 39, there is shown a retrofit installation of one form of the apparatus in accordance with the present invention. In a typical hatch installed outside of a building, the existing structure will include a drain channel 98 that extends around the entire circumferential extent of the hatch assembly. A base 100 and opposed first and second walls 90 and 102 define the drain channel 98. As seen in FIG. 39, a frame member 96 particularly designed for the retrofit market has a generally L-shaped contour. The frame member 96 is secured by a bolt 97 to the inboard (nearer the center of the hatch assembly) side 102 of the drain channel 98. More specifically, the frame member 96 is nested within the drain channel 98. A coil spring actuating mechanism 104, similar to the coil spring actuating mechanism 30 illustrated in FIG. 25, is secured by fasteners 106 to the outboard wall 90 of the drain channel 98. Thus, it will be seen that the frame member 96 allows attachments via the circumferential groove 108 and specifically the attachment of a variety of devices in the manner described with respect to the embodiments intended for original equipment hatch assemblies.

Figure 40:
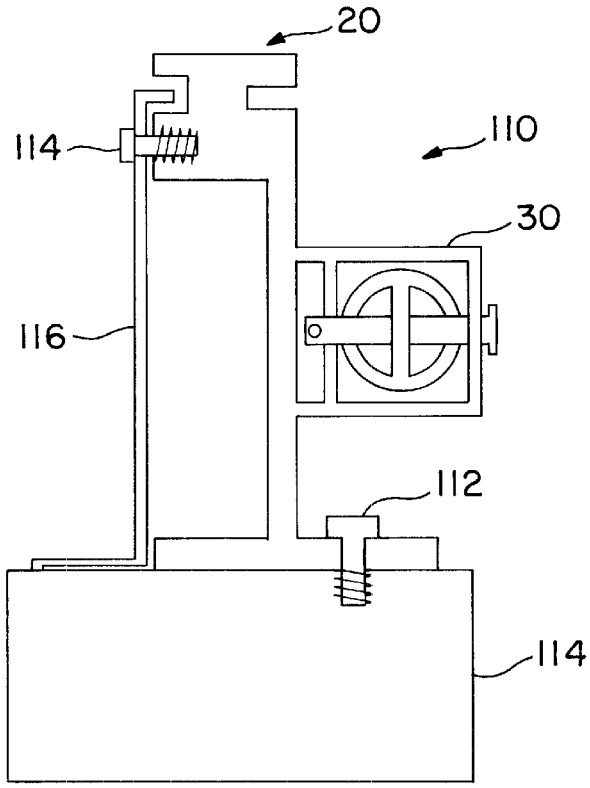
FIG. 40 is a diagrammatic view of a roof hatch installation with a full exterior skirt.

A roof hatch installation 110 is shown in FIG. 40. This installation utilizes the same frame member 20 used in other 10 installations. Bolts 112 secure the frame member 20 to the roof 114. A coil extension spring actuating assembly 30 is fixed to the inboard face of frame member 20. A full exterior skirt 116 (also referred to as a fully enclosed curb) is secured by a bolt 114 to the frame member 20.

Figure 41:
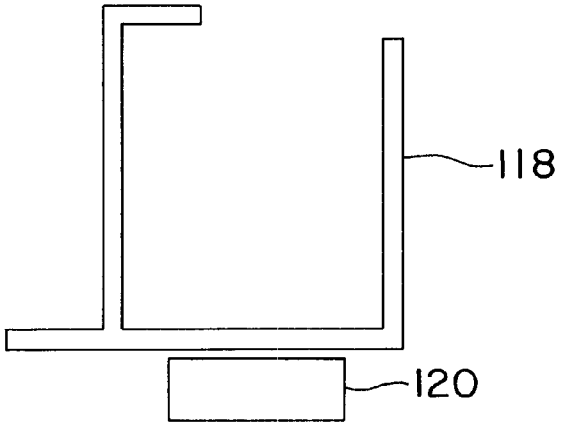
FIG. 41 is a diagrammatic view of a drainage channel frame profile in accordance with one form of the present invention.
Figure 42:
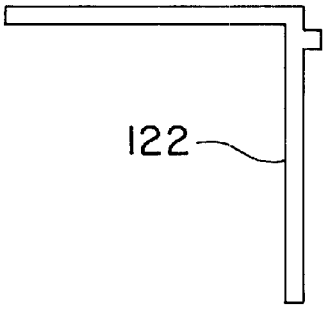
FIGS. 42 and 43 are diagrammatic views of angle frame profiles used on drainage frames commonly used for interior floor hatches.
Figure 43:
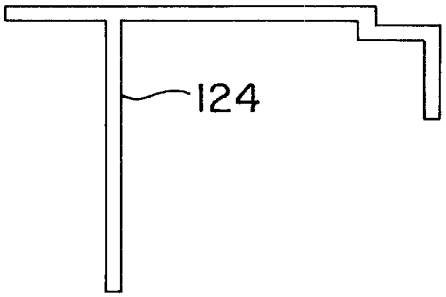
Figure 44:
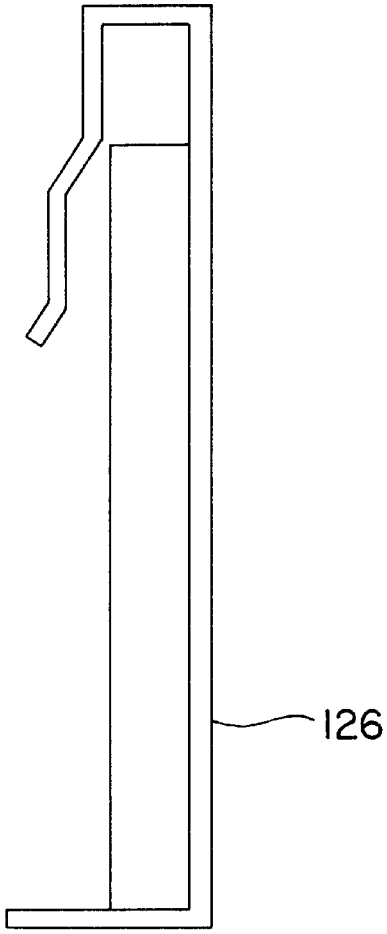
FIG. 44 is a diagrammatic view of a roof hatch curb having a capped flashing for waterproofing.

With reference to FIG. 41, some embodiments of the present invention incorporate a drain channel 118 (also known as a gutter or trough frame) having a drain coupling 20 welded to the underside of the drain channel 118 for connection to a drain pipe. This structure has particular application is for exterior sidewalk hatches. Other embodiments of the present invention will incorporate angle frame members such as members 122, 124 shown respectively in FIGS. 42 and 43. Such members are commonly used for interior floor hatches. A preferred form of a roof hatch curb 126 is shown in FIG. 44.

As used herein, the term "cable" refers to a multistrand steel cable as well as equivalent means for transferring a tension force, including other metallic, plastic and fiber cables. In the preferred embodiments the cover 12 is provided with a stiffener 14 having an elongated slot 16 formed therein. Those skilled in the art will recognize that various other structures may be utilized including, but not limited to, T-shaped slots to achieve the sliding meshing engagement that is required.

While the present invention has been described with reference to the preferred embodiments illustrated in the drawing, the detailed description thereof is not intended to limit the scope of the invention as claimed in the appended claims.

What is claimed is:

1. A universal hatch assembly for accessing an enclosure which comprises:

a door having a first side and a second side;

a frame defining an opening;

hinge means mounting said door to said frame, said hinge means allowing pivotal movement of said door about a first axis between a first position in which said door covers said opening and a second position in which said door does not cover said opening;

said first side of said door being disposed interiorly when said door covers said opening, said first side of said door having an elongated channel extending in substantially orthogonal relationship to said first axis;

an operating lever for positioning said door, being pivotally connected to said frame at a first lever location and being dimensioned and configured for sliding meshing engagement with said elongated channel at a second lever location axially spaced from said first location; and counterbalance means for biasing the pivotal position of said operating lever with respect to said frame comprising a coil extension spring, said counterbalance means further including a cable extending from said coil extension spring and connecting to said operating lever at a third location spaced from said first and second locations.

2. A universal hatch assembly in accordance with claim 1, wherein said coil extension spring has a second axis and said second axis is disposed in generally parallel relationship to said first axis.

3. A universal hatch assembly in accordance with claim 2, wherein said opening is defined by a first side and said first axis and said second axis are disposed proximate to said first side.

4. A universal hatch assembly in accordance with claim 3, wherein said door has a depending flange, said elongated channel being formed in said depending flange.

5. A universal hatch assembly in accordance with claim 4, wherein a said generally cylindrical member is dimensioned and configured for sliding meshing engagement with said elongated channel.

6. A universal hatch assembly in accordance with claim 1, further including a sheave cooperating with said cable.

7. A universal hatch assembly in accordance with claim 6, wherein said frame includes a first peripheral groove extending around substantially all of said frame.

8. A universal hatch assembly in accordance with claim 7 further including at least one module having a mounting surface dimensioned and configured for engaging said first peripheral groove.

9. A universal hatch assembly in accordance with claim 8, wherein said hinge means comprises first and second plates coupled by a hinge pin, said frame being dimensioned and configured for receiving said first plate, said second plate mounting said door, said first plate having a second groove, said second groove being disposed in aligned relationship with said first peripheral groove to define a substantially continuous uniform groove about the entire periphery of said frame.

10. A universal hatch assembly in accordance with claim 8, wherein said module is a skirt.

11. A universal hatch assembly in accordance with claim 8, wherein said module is a clamp.

12. A universal hatch assembly in accordance with claim 8, wherein said module is a flange with an integral carpet/tile stop.

13. A universal hatch assembly in accordance with claim 8, wherein said module is a flange for positioning said hatch assembly with respect to said opening.

14. A universal hatch assembly in accordance with claim 7, wherein said frame includes a second peripheral groove extending around substantially all of said frame.

15. A universal hatch assembly in accordance with claim 14, wherein said second peripheral groove includes a plurality of longitudinally extending ridges dimensioned and configured for threadably engaging a threaded fastener.

16. A universal hatch assembly in accordance with claim 14, wherein said first peripheral groove and said second peripheral groove are parallel.

17. A universal hatch assembly in accordance with claim 1, wherein said frame is a substantially rectangular structure having four interior sides and said spring is disposed in generally parallel relationship to one said frame.

18. A universal hatch assembly in accordance with claim 1 further comprising adjustment means for adjusting the biasing force of said counterbalance means.

* * * * *